United States Patent [19]

McCaffrey

[11] 3,946,509

[45] Mar. 30, 1976

[54] TEMPORARY SIGN FOR AUTOMOBILES

[75] Inventor: David McCaffrey, Toronto, Canada

[73] Assignee: Gravure-Craft Ltd., Toronto, Canada

[22] Filed: Aug. 15, 1974

[21] Appl. No.: 497,556

[52] U.S. Cl. ..... 40/129 C; 40/10 A; 116/28 R

[51] Int. Cl.[2] ..... G09F 21/04

[58] Field of Search ..... 40/129 C, 37.1, 125 H, 40/125 F, 125 R, 125 N, 125 G, 129 R, 10 A, 10 B; 116/28 R

[56] References Cited

UNITED STATES PATENTS

| | | | |
|---|---|---|---|
| 1,953,756 | 4/1934 | Hennessey et al. | 40/129 C |
| 2,014,641 | 9/1935 | Wray | 40/10 A |
| 2,752,709 | 7/1956 | Gough | 40/129 C |
| 2,975,539 | 3/1961 | Anderson | 40/125 F |
| 3,305,961 | 2/1967 | Lanzon et al. | 40/129 C |
| 3,399,489 | 9/1968 | Rogers | 40/129 R |
| 3,563,200 | 2/1971 | Grossman | 116/28 R |

*Primary Examiner*—Louis G. Mancene
*Assistant Examiner*—John F. Pitrelli
*Attorney, Agent, or Firm*—George H. Riches & Associates

[57] ABSTRACT

This invention relates to an improved sign which may be quickly and easily detachably secured to an automobile body by being inserted into the space between the trunk lid or front hood and the fenders of the automobile. The flat rigid sign is between ⅛ and ⅜ inches in thickness and may be formed of a corrugated cardboard panel sandwiched between two flat cardboard panels and covered by a smooth vinyl coating to be resilient to pressure from the side. It is attached to the automobile by being manually depressed into the vertical space until its lower edge abuts on a horizontal portion of one of the members forming the space, in which position it is retained substantially vertically by being resiliently engaged between the sides of the space. In a preferred embodiment, the sign has a flexible lower edge portion provided by the vinyl covering extending downward beneath the cardboard panels, which is bent sideways to engage one of the members defining the space. The sign is very economical to manufacture, simple to attach and detach, convenient to transport and store when not in use, and may be reused a large number of times.

1 Claim, 6 Drawing Figures

TEMPORARY SIGN FOR AUTOMOBILES

BACKGROUND OF THE INVENTION

This invention relates generally to signs and more particularly to a sign which may be quickly and easily temporarily secured to an automobile in a readily visible position.

It is well known to temporarily attach signs to automobiles by a number of different methods. Detachable bracket members may be used but these have the disadvantages that they cannot be quickly and easily attached and removed and that they are relatively expensive to make. Other temporary signs may be attached by the use of adhesives or tape but this similarly has the disadvantages that it may not be done quickly and easily, the signs are not reusable a number of times and furthermore there is a possibility that the finish of the automobile body may be marred. In addition, both of these previously known methods have the further disadvantage that the signs cannot be conveniently transported and stored in large numbers.

More recently, these disadvantages have been partially overcome by signs which may be magnetically attached to the body of the automobile. However, these improved signs still have the disadvantage that they are relatively expensive to use as they are not cheap to manufacture and often are lost during use. One application of this type of sign is to indicate a funeral procession, and in this case other indicia such as flags are commonly used. These may be attached to the automobile radio antenna or to the body by suction, but again they have the disadvantage that they are often lost during use and are expensive to replace.

SUMMARY OF THE INVENTION

Accordingly, it is an object of the present invention to at least partially overcome these disadvantages by providing a sign which is very inexpensive to manufacture in quantity, is very convenient to transport and store when not in use, may be very quickly and simply installed on an automobile body in a visible and secure position and is reusable.

To this end, in one of its aspects, the invention provides a substantially flat rigid sign adapted to be removably secured in an erect position in a substantially vertical plane by being resiliently engaged along a lower edge thereof in a space laterally adjacent the trunk lid or front hood of an automobile.

In another of its aspects the invention further provides a substantially flat rigid rectangular sign adapted to be manually removably positioned in a horizontal erect position in a vertical plane by being engaged along a lower edge thereof in a space laterally adjacent the trunk lid or front hood of an automobile, the space being defined between a first flat vertically extending flange member and a second flange member having an upper vertically extending flat portion and an integral lower horizontal portion which extends beneath but is spaced from the first flange member, the sign comprising a pair of flat rectangular cardboard panels; a rectangular corrugated cardboard panel sandwiched between the pair of flat panels; and a flexible vinyl covering shaped to smoothly enclose the cardboard panels and to extend downward from the cardboard panels to the lower edge of the sign, whereby the sign has a resilient main body portion ⅛ to ⅜ inches in thickness and a flexible narrow thinner lower edge portion formed by the vinyl covering, engagement of the sign in the space being by downward insertion of the lower edge of the sign into the space to the erect position in which a lower portion of the main body portion is resiliently engaged between the first flange member and the upper portion of the second flange member, and the lower edge portion is bent by contact with the lower portion of the second flange member to a position partially beneath the first flange member.

Further objects and advantages of the invention will appear from the following description taken together with the accompanying drawings.

DESCRIPTION OF THE PREFERRED EMBODIMENTS

Figure 1:
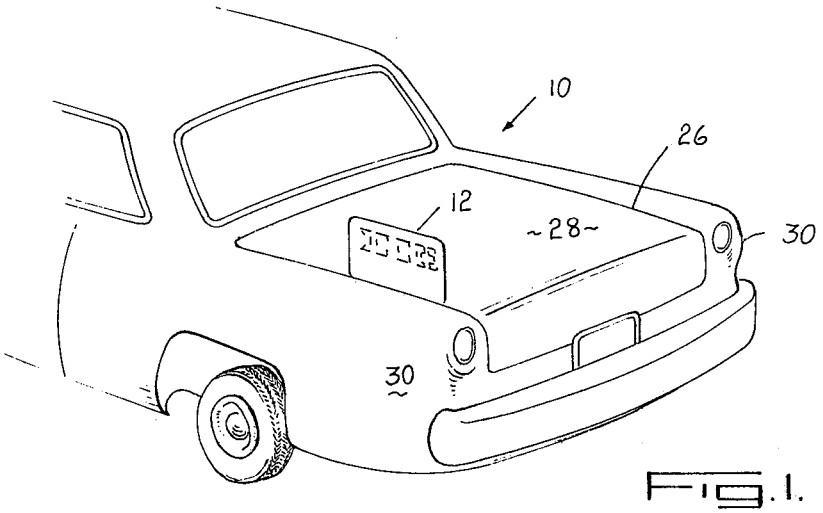
FIG. 1 is a partial perspective view showing a sign according to the invention in an erect position on an automobile.
Figure 2:
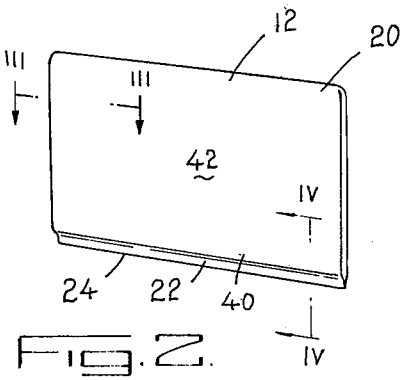
FIG. 2 is a perspective view of a preferred embodiment of the invention.
Figure 3:
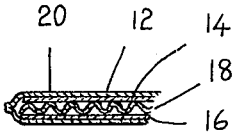
FIG. 3 is a sectional view taken along line III—III in FIG. 2.
Figure 4:
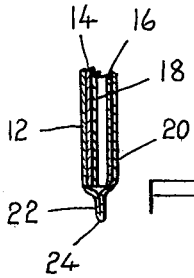
FIG. 4 is a sectional view taken along line IV—IV in FIG. 2.

Reference is first made to FIG. 1 which shows an automobile 10 having a sign 12 according to the invention attached to it. As may clearly be seen from FIGS. 2 to 4, the sign 12 is formed of a pair of identical flat cardboard panels 14, 16 between which is sandwiched a corrugated cardboard panel 18 of the same size and shape, all of which are enclosed in a flexible vinyl covering 20. It is readily apparent that the sign may be very economically manufactured and is substantially resilient to pressure applied from the sides. While being very inexpensive to manufacture, this structure provides a sign which is substantially rigid, sufficiently resilient and adapted to be either preprinted with a selected message prior to assembly or lettered as desired following manufacture. As clearly seen in FIG. 4, in the preferred embodiment of the sign, the flexible vinyl covering 20 extends a short distance downward from the cardboard panels to form a narrow flexible lower edge portion 22 along the lower edge 24 of the sign.

Figure 5:
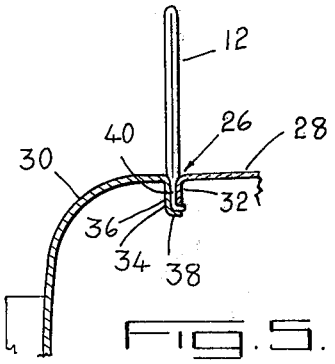
FIG. 5 is a partial sectional view showing the preferred embodiment of the invention in an erect position on the automobile body.
Figure 6:
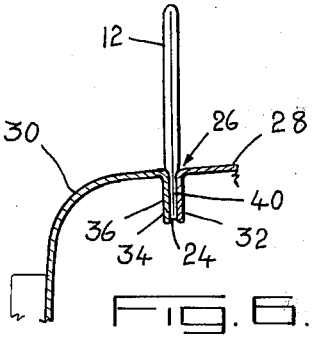
FIG. 6 is a view similar to FIG. 5 showing a second embodiment of the invention in position on an automobile body.

As shown in FIGS. 1, 5 and 6, most automobiles have narrow spaces 26 extending between the trunk lid 28 and rear fenders 30 of the automobile. Similar spaces are also usually provided between the front hood and front fenders (not shown) in which the sign may also be positioned. Referring to FIG. 5, the space 26 is defined between a first member 32 and a second member 34 which often has an upper vertically extending flat portion 36 and a lower portion 38 which is bent to extend beneath the first member 32.

In use, the sign 12 is manually secured to the automobile 10 by inserting the lower edge 24 into the space 26 and forcing the sign downward as far as possible to an erect position. As the sign moves downward, the flexible lower edge portion 22 formed by the vinyl covering 20 contacts the lower portion 38 of the second member 34 and is bent sideways beneath the first member 32, while a lower portion 40 of the main body portion 42 of the sign formed by the cardboard panels is resiliently compressed between the first member 32 and the upper portion 36 of the second member 34. It has been found that a sign between ⅛ and ⅜ inches in thickness may be quickly attached to most present automobiles in this manner sufficiently securely to be retained in this position during movement of the automobile through a procession. The sign 12 may then be quickly and easily detached from the automobile 10 by merely lifting it from the space 26 and conveniently stored for reuse.

FIG. 6 shows a second embodiment of the invention without the lower edge portion 22 which it has been found to be adequate to retain smaller signs securely in place. As is readily apparent, in this case the sign 12 is retained in position in the space 26 merely by the lower portion 40 of the main body portion 42 of the sign being resiliently engaged between the first member 32 and the upper flat portion 36 of the second member 34 with the lower edge 24 of the sign 12 abutting on the lower portion 40 of the second member 34.

Although the disclosure describes and illustrates preferred embodiments of the invention, it is to be understood that the invention is not restricted to these particular embodiments. For instance, it is within the scope of the invention to form the sign of other suitable material or materials such as a layer of resilient foam adhesively secured between two flat cardboard panels.

What I claim is:

1. A substantially flat one piece rigid rectangular sign to be manually removably positioned in a horizontal erect position in a vertical plane by being engaged along a lower edge thereof in a space laterally adjacent the trunk lid or front hood of an automobile, the space being defined between a first flat vertically extending flange member and a second flange member having an upper vertically extending flat portion and an integral lower horizontal portion which extends beneath but is spaced from the first flange member, the sign comprising:

a. a pair of flat rectangular panels;

b. a rectangular resilient panel sandwiched between the pair of flat panels; and c. a flexible vinyl covering shaped to smoothly enclose the cardboard panels and to extend downward from the cardboard panels to the lower edge of the sign, whereby the sign has a resilient main body portion ⅛ to ⅜ inches in thickness and a flexible narrow thinner lower edge portion formed by the vinyl covering, engagement of the sign in the space being by downward insertion of the lower edge of the sign into the space to the erect position in which a lower portion of the main body portion is resiliently engaged between the first flange member and the upper portion of the second flange member, and the lower edge portion is bent by contact with the lower portion of the second flange member to a position partially beneath the first flange member.

* * * * *

UNITED STATES PATENT OFFICE

CERTIFICATE OF CORRECTION

Patent No. 3,946,509 Dated March 30, 1976

Inventor(s) David McCaffrey

It is certified that error appears in the above-identified patent and that said Letters Patent are hereby corrected as shown below:

Claim 1, paragraph (c), line 2 delete "cardboard".

Claim 1, paragraph (c), line 3 delete "cardboard".

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*